US005313257A

United States Patent [19]

Kashima et al.

[11] Patent Number: 5,313,257

[45] Date of Patent: May 17, 1994

[54] PAPER CASSETTE FOR USE IN AN IMAGE FORMING DEVICE

[75] Inventors: Hiroyuki Kashima; Naohisa Kinoshita, both of Nagoya; Mitsuaki Inoue, Tsu, all of Japan

[73] Assignee: Brother Kogyo Kabushiki Kaisha, Nagoya, Japan

[21] Appl. No.: 905,294

[22] Filed: Jun. 29, 1992

[30] Foreign Application Priority Data

Aug. 22, 1991 [JP] Japan ..... 3-210601

[51] Int. Cl.[5] ..... G03G 21/00

[52] U.S. Cl. ..... 355/309; 271/164; 271/171; 271/223; 355/311

[58] Field of Search ..... 355/309, 75, 311; 271/171, 164, 223

[56] References Cited

U.S. PATENT DOCUMENTS 4,780,740 10/1988 Fukae ..... 271/171 X
5,040,022 8/1991 Kinoshita et al. .
5,155,537 10/1992 Komatsu et al. ..... 355/309

FOREIGN PATENT DOCUMENTS 56-7841 1/1981 Japan ..... 271/171
58-139961 8/1983 Japan .
59-97936 6/1984 Japan ..... 271/9
59-167426 9/1984 Japan ..... 271/9
59-203025 11/1984 Japan ..... 271/171
61-217465 9/1986 Japan ..... 271/223
61-238655 10/1986 Japan ..... 271/223
1-233463 9/1989 Japan ..... 355/309
2-276729 11/1990 Japan ..... 271/171

*Primary Examiner*—A. T. Grimley
*Assistant Examiner*—Shuk Y. Lee
*Attorney, Agent, or Firm*—Oliff & Berridge

[57] ABSTRACT

A paper cassette adapted to be removably mounted in a paper feed section of an image forming device. The paper cassette is generally constructed of a main frame and an auxiliary frame slidably engaged with the main frame. The auxiliary frame is moved forwardly or rearwardly relative to the main frame in accordance with a longitudinal size of the desired sheets of paper to be stored in the paper cassette. Thereafter, the auxiliary frame is fixedly positioned by a position adjusting member provided on the main frame. Thus, a longitudinal size or length of the paper cassette to be mounted into the paper feed section of the image forming device can be varied in accordance with a longitudinal size of the desired sheets of paper to be used, thereby reducing the types of paper cassettes required.

17 Claims, 7 Drawing Sheets

PAPER CASSETTE FOR USE IN AN IMAGE FORMING DEVICE

BACKGROUND OF THE INVENTION

1. Field of the Invention

The invention relates to a paper cassette used in an image forming device such as a copying machine or a laser printer.

2. Description of Related Art

A known paper cassette for use with an image forming device, such as a laser printer, is adapted to be removably mounted into a paper feed section, formed at a lower portion of the body of the image forming device, from the front side thereof. The paper cassette is configured to have an open box-shape on the upper side. Different types of paper cassettes are used for different sizes of paper with one type paper cassette for each size of paper.

Alternatively, a paper cassette, provided with a guide member, is used where the guide member is movably arranged in the paper cassette. In operation, the guide member is moved according to a size of paper to be used, so that when adjusted, it guides the paper by being in contact with a side edge of the paper.

SUMMARY OF THE INVENTION

In the case of using a single type of paper cassette having a fixed size, particularly the fixed size in a longitudinal direction (i.e., the depth direction), previously set to correspond to the maximum size of the paper to be used, there is a problem in that a large dead space results when storing small-sized paper in the paper cassette and a large volume of the paper cassette, when removed from the image forming device, is unused. On the other hand, when using the plural types of paper cassettes, having different sizes corresponding to the various sizes of sheets of paper to be used, it is necessary to prepare a different die to produce each of the paper cassettes, causing an increase in cost and rendering stock control of the paper cassettes complex and troublesome. It is accordingly, a first object of the present invention to solve the identified problems.

Further, in the case where a paper feed unit (paper feed roller) is located at a front portion of the body of the image forming device, the paper cassette is mounted into the body so that a front surface of the paper cassette is flush with a front surface of the body. In this case, when the length of the paper cassette is greater than that of the body, a portion of the paper cassette projects rearwardly from a rear end of the image forming device body. As a result, an upper surface of the rear portion of the paper cassette projecting from the image forming device body is exposed to the outside of the image forming device body, causing a problem in that dust is deposited onto the upper surface of the paper stored in the paper cassette. It is accordingly a second object of the present invention to solve this problem.

According to one aspect of the invention, achieving the first object mentioned above, there is provided a paper cassette adapted to be removably mounted into a paper feed section of an image forming device, the paper cassette comprising a main frame open on an upper side thereof and an auxiliary frame mounted to the main frame so as to be movable frontward and rearward relative to the main frame in accordance with a desired longitudinal size of sheets of paper to be stored in the paper cassette. Accordingly, it is only necessary to prepare a single kind of paper cassette regardless of different sizes of paper. As a result, production costs for the paper cassette can be reduced and stock control for the paper cassette(s) is greatly simplified.

According to another aspect of the invention, achieving the second object mentioned above, there is provided in an image forming device, including a body and a paper cassette adapted to be removably mounted into the body from a front side thereof, a cover member provided on one of the body and the paper cassette for covering an upper surface of the rear portion of the paper cassette that projects rearward from a rear side of the body. Accordingly, the upper surface of the rear projecting portion of the paper cassette can be covered with the cover member without the need to increase the longitudinal size of the image forming device body, thus avoiding the depositing of dust onto the upper surface of the paper stored in the paper cassette. Further, the body of the image forming device can be constructed compactly at a low cost.

Other objects and features of the invention will be more fully understood from the following detailed description and appended claims when taken with the accompanying drawings.

DETAILED DESCRIPTION OF THE PREFERRED EMBODIMENTS

Figure 1:
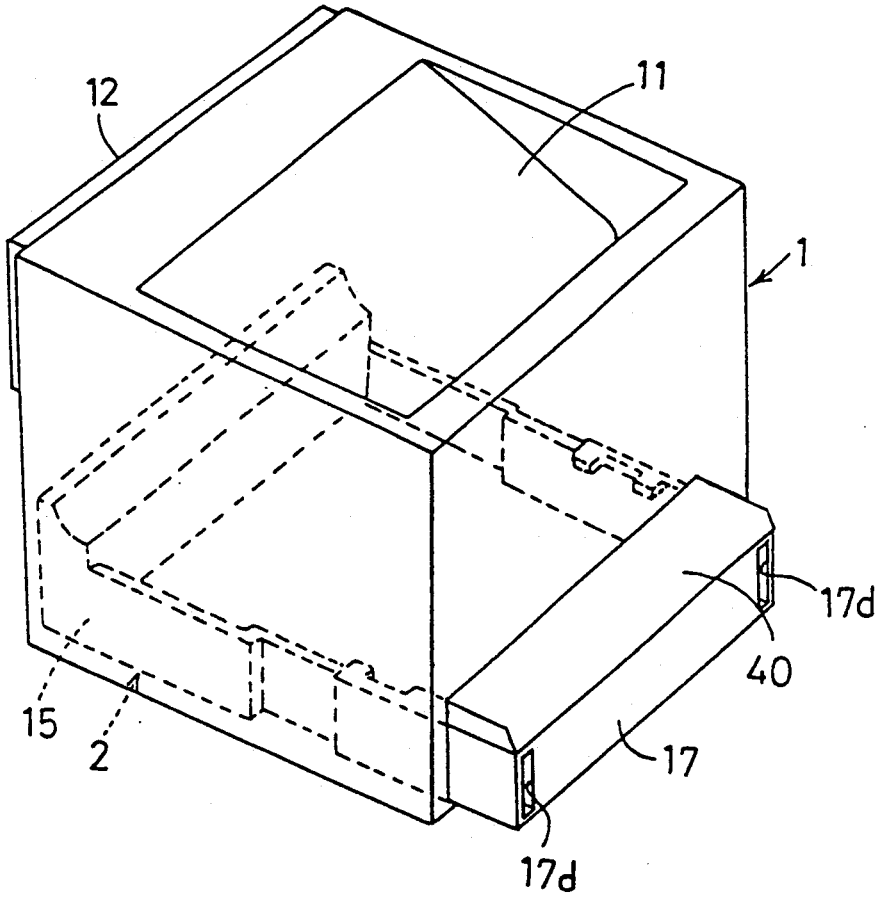
FIG. 1 is a perspective view of an image forming device in which a paper cassette is mounted in a first preferred embodiment according to the invention.
Figure 2:
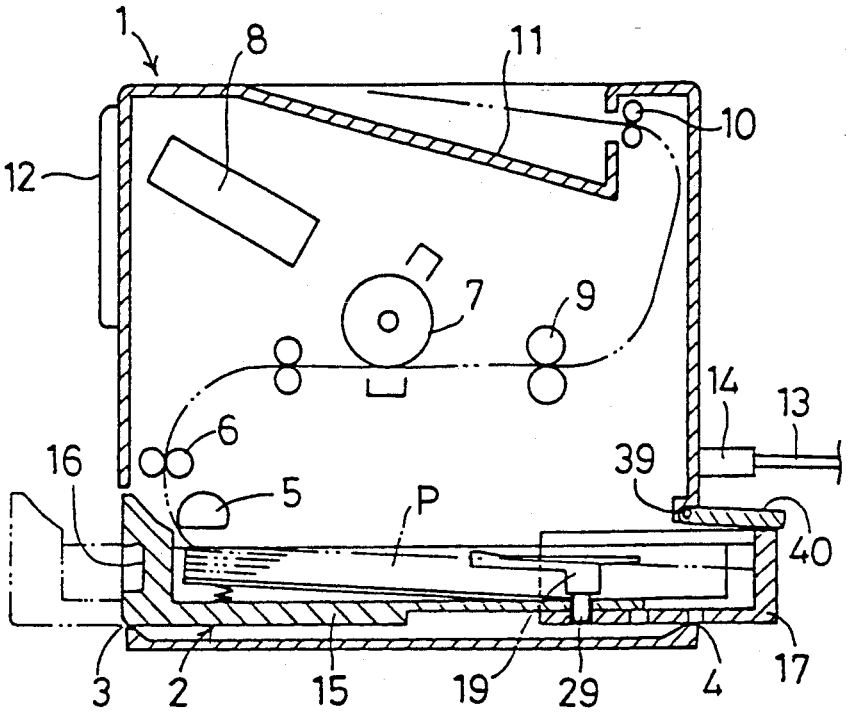
FIG. 2 is a vertical sectional view of the image forming device shown in FIG. 1.

There will now be described some preferred embodiments of the invention with reference to the drawings. Referring to FIGS. 1 and 2, reference numeral 1 generally designates the body of an image forming device such as a laser printer, and reference numeral 2 generally designates a paper cassette, for storing a plurality of sheets of paper P, for mounting in the body 1 of the image forming device. A lower portion of the body 1 is formed as a paper feed section. The paper feed section of the body 1 is provided with a front opening 3 for allowing insertion of the paper cassette 2 and a rear opening 4 for allowing projection of a rear portion of the paper cassette 2. The sheets of paper P are picked up, one by one, by means of a semicircular paper feed roller 5 in a paper feed unit which comprises the paper feed section. The paper P is carried through a carrier roller pair 6 to the surface of a photosensitive drum 7. An electrostatic latent image is formed on the surface of the photosensitive drum 7 by a laser beam according to a print (image) signal from a laser/scanner section 8 provided with a laser unit, a rotary polygonal member and so on. A toner is charged and deposited onto the electrostatic latent image, and the charged toner is transferred to the paper P. Thereafter, a developed image on the paper P is fixed by a fixing unit mechanism 9 and the paper P is ejected, through a paper eject unit mechanism 10, to a paper eject tray 11. An operation panel 12 is provided on a front surface of the body 1. A wiring cord 13 with a connector 14 is connected to a rear surface of the body 1 at a position over the rear opening 4.

A printing mechanism in such a general, known laser printer is disclosed, for example, in U.S. Pat. No. 5,040,022.

The paper cassette 2 is generally constructed of a main frame 15 and an auxiliary frame 17, both being made of a synthetic resin. The main frame 15 is configured to have a rectangular shape as viewed in plan in such a manner as to be open on the upper side. The main frame 15 has a closed front end provided with a handling recess 16, and has an open rear end. The auxiliary frame 17 is relatively movably mounted to the main frame 15 in such a manner that a position of the auxiliary frame 17 relative to a rear portion of the main frame 15 can be adjusted in a longitudinal direction (front and rear direction) of the main frame 15. That is, an upper surface of a bottom plate 17*a* of the auxiliary frame 17 is slidably fitted with a lower surface of a bottom plate 15*a* of the main frame 15, and inner side surfaces of right and left side plates 17*b* of the auxiliary frame 17 are slidably fitted with outer side surfaces of right and left side plates 15*b* of the main frame 15, respectively. Further, right and left tabular portions 18, formed at upper edges or surfaces of the right and left side plates 17*b* of the auxiliary frame 17 are slidably fitted with upper edges of the right and left side plates 15*b* of the main 15. Rear end portions of the right and left side plates 15*b* of the main frame 15 are inserted through a pair of slots 17*d* formed at right and left rear corner portions, respectively, connecting the right and left side plates 17*b* with a rear plate 17*c* of the auxiliary frame 17, so that the rear end portions of the side plates 15*b* can project rearwardly from the slots 17*d* at the rear corner portions of the auxiliary frame 17. With this arrangement, the auxiliary frame 17 is slidably mounted to the main frame 15 in such a manner that the former is prevented from separating from the latter while being allowed to be moved, relative to the latter, in the longitudinal direction.

A position adjusting member 19 made of a synthetic resin is located just inside the left side plate 15*b* of the main frame 15. The bottom plate 15*a* of the main frame 15 is provided with a longitudinally elongated guide hole 20 extending in opposed relationship to the position adjusting member 19. The bottom plate 17*a* of the auxiliary frame 17 is formed with a plurality of positioning holes 21*a*, 21*b*, 21*c*, and so on, exposed to the elongated guide hole 20 of the bottom plate 15*a* of the main frame 15. The positioning holes 21*a*, 21*b*, 21*c*, and so on, are positioned to correspond to various longitudinal sizes (such as B5, EX (executive size), LT (letter size), A4, EN (envelope size), and LG (legal size)) of the paper P.

Figure 5:
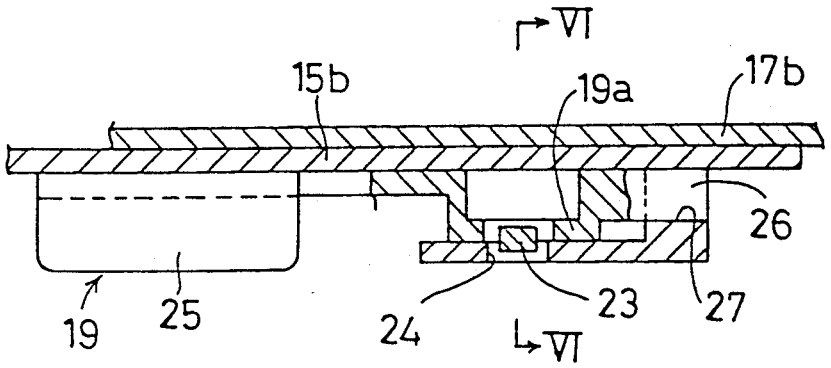
FIG. 5 is a cross section taken along the line V—V in FIG. 4.
Figure 6:
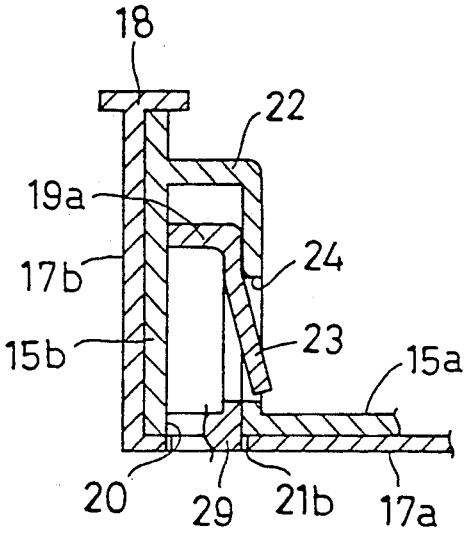
FIG. 6 is a cross section taken along the line VI—VI in FIG. 5.

The position adjusting member 19 is provided with a primary portion 19*a* having a substantially rectangular shape as viewed in side elevation and a U-shaped cross section. The primary portion 19*a* of the position adjusting member 19 is slidably engaged at its lower end with the elongated guide hole 20 of the bottom plate 15*a* of the main frame 15. A supporting member 22 having an inverted L-shaped cross section is connected between the upper surface of the bottom plate 15*a* and the inner side surface of the left side plate 15*b*. A side surface of the primary portion 19*a* is vertically slidably engaged with an inner side surface of the supporting member 22. An elastic tab 23 having a lower free end is formed to project outwardly from the side surface of the primary portion 19*a*. The elastic tab 23 of the primary portion 19*a* is loosely and unreleasably engaged with a vertically elongated hole 24 formed through the side plate of the supporting member 22 (see FIGS. 5 and 6). A lever 25 projects frontward from the primary portion 19*a* at its upper end and a leaf spring portion 26 projects rearward from the primary portion 19*a* at its upper end. A rear free end of the leaf spring portion 26 is inserted into a supporting hole 27 formed at a rear end of the supporting member 22, and an upper surface of the rear free end of the leaf spring portion 26 is in contact with a restriction surface 28 formed at the top of the supporting hole 27. Accordingly, when the lever 25 is lifted to upwardly move the primary portion 19*a*, an elastic force of the leaf spring portion 26 is generated against the lifting force applied to the lever 25.

Figure 4:
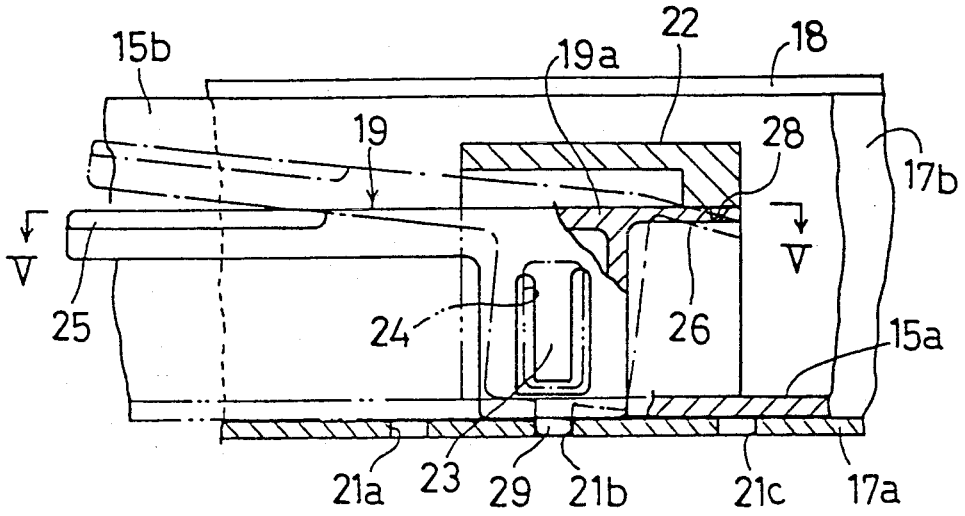
FIG. 4 is a cross section taken along the line IV—IV in FIG. 3.

A positioning projection 29 is downward projected from the lower end of the primary portion 19*a* of the position adjusting member 19. The positioning projection 29 is normally engaged with one of the positioning holes 21*a*, 21*b*, 21*c*, and so on, of the bottom plate 17*a* of the auxiliary frame 17. In such case, the lever 25 of the position adjusting member 19 is in a substantially horizontal condition. When the lever 25 is lifted or rotated upward, the positioning projection 29 is disengaged from the one of the positioning holes 21*a*, 21*b*, 21*c*, and so on (see FIG. 4).

Figure 3:
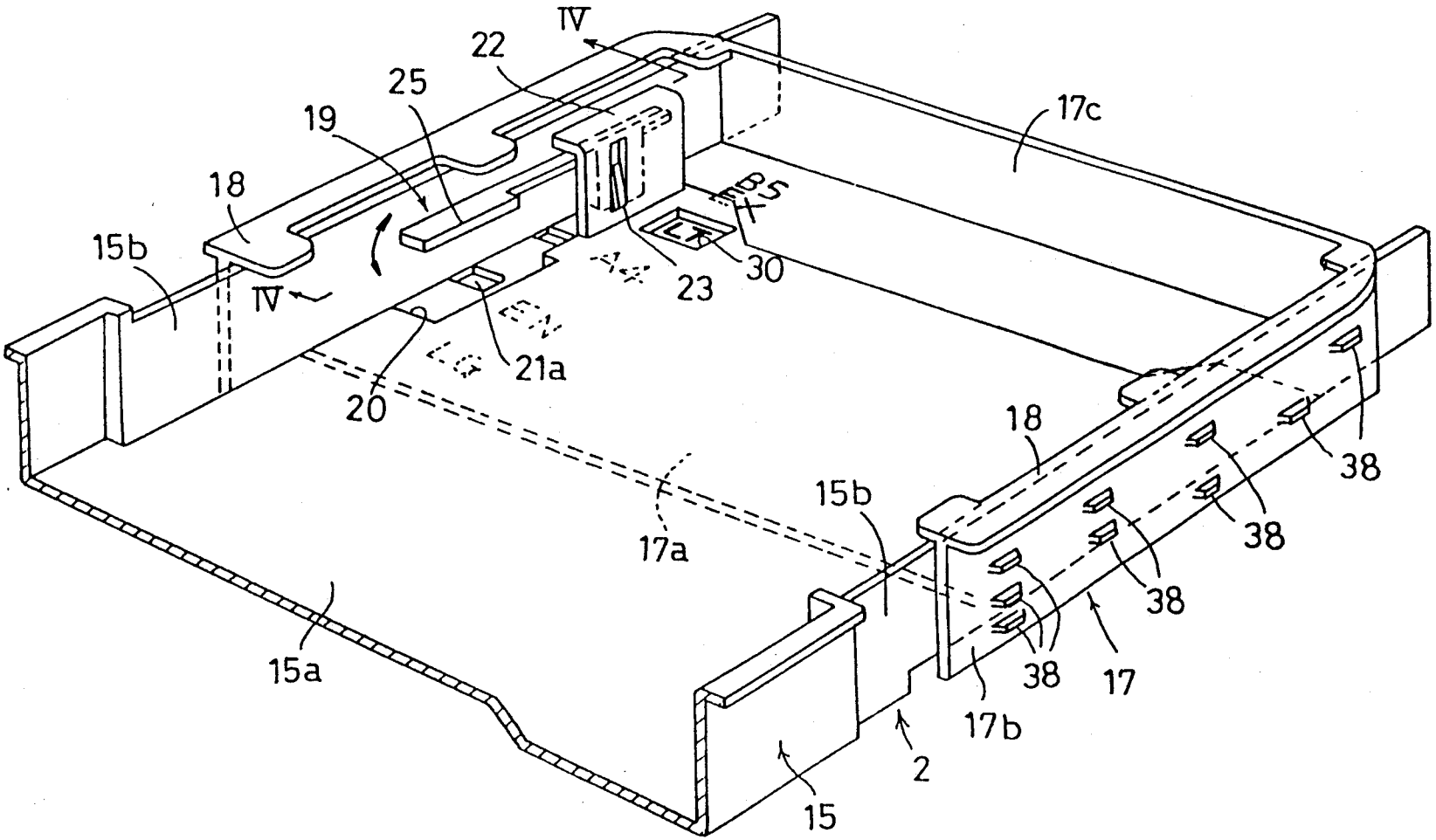
FIG. 3 is a perspective view, partially cutaway, of an essential part of the paper cassette shown in FIGS. 1 and 2.

Reference numeral 30 designates a window formed through the bottom plate 15*a* of the main frame 15. The window 30 is located beside the primary portion 19*a* of the position adjusting member 19. Further, a plurality of symbols (such as B5, EX, LT, A4, EN, and LG) corresponding to the longitudinal sizes (such as B5, EX, LT, A4, EN, and LG) of the paper P are marked (indicated) on the upper surface of the bottom plate 17*a* of the auxiliary frame 17 beside the positioning holes 21*a*, 21*b*, 21*c*, and so on, respectively. Accordingly, when the positioning projection 29 is engaged with a desired one of the positioning holes 21*a*, 21*b*, 21*c*, and so on, one of the above symbols corresponding to a desired longitudinal size of the paper P can be observed through the window 30 (see FIG. 3).

In adjusting the position of the auxiliary frame 17 relative to the main frame 15 in accordance with the longitudinal size of the paper P desired to be stored in the paper cassette 2, the lever 25 of the position adjusting member 19 is first rotated upward to thereby disengage the positioning projection 29 from one of the positioning holes 21*a*, 21*b*, 21*c*, and so on of the auxiliary frame 17. Then, while maintaining such a disengaged condition of the positioning projection 29, the auxiliary frame 17 is moved frontward or rearward. When the one of the symbols corresponding to the desired size of the paper P appears in the window 30, during the movement of the auxiliary frame 17, the lifting force applied to the lever 25 is removed. As a result, the positioning projection 29 is brought into engagement with the desired one of the positioning holes 21*a*, 21*b*, 21*c*, and so on corresponding to the desired size of paper P by the elastic force of the leaf spring portion 26 of the position adjusting member 19 and the weight of the primary portion 19*a*. Thus, the auxiliary frame 17 is fixedly positioned in the longitudinal direction relative to the main frame 15 in accordance with the desired size of the paper P.

Figure 7:
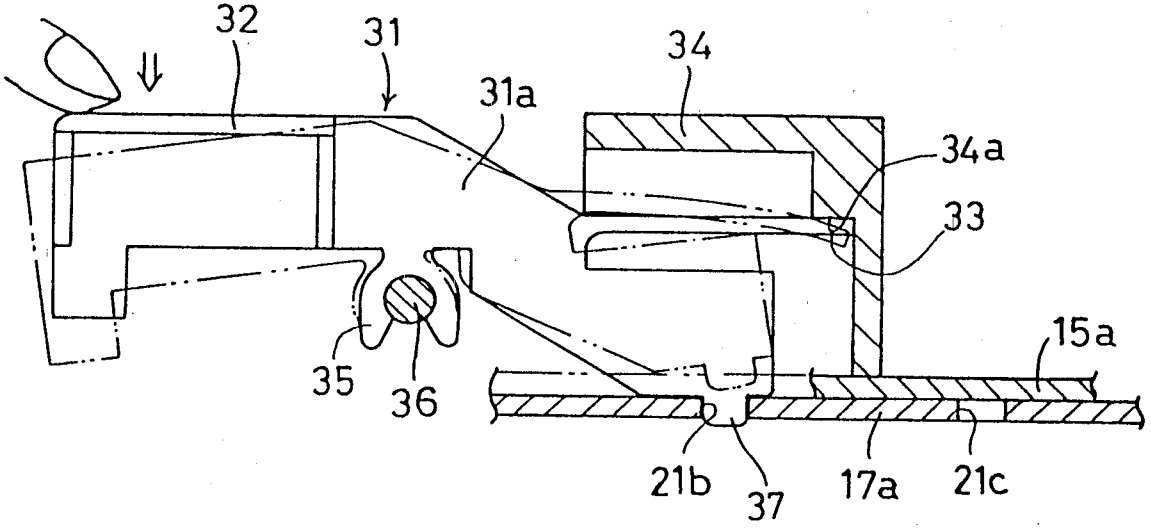
FIG. 7 is a sectional side view illustrating a second preferred embodiment of a position adjusting member.

FIG. 7 shows a second preferred embodiment of the position adjusting member 19. Referring to FIG. 7, reference numeral 31 designates a position adjusting member according to the second preferred embodiment. A lever 32 projects frontward from a primary portion 31*a* of the position adjusting member 31 and a leaf spring portion 33 projects rearward from the primary portion 31*a*. An upper surface of a rear end portion of the leaf spring portion 33 is in contact with a restriction surface 34*a* of a supporting member 34. The primary portion 31*a* is provided with a pivotal portion 35 rotatably engaged with a lateral shaft 36 projecting from the inner surface of the left side plate 15*b* of the main frame 15. When the lever 32 is depressed downwardly to upwardly rotate the primary portion 31*a* about the lateral shaft 36, against elastic force of the leaf spring portion 33, a positioning projection 37 projecting downward from a lower end of the primary portion 31*a*, is disengaged from one of the positioning holes 21*a*, 21*b*, 21*c*, and so on, thereby allowing movement of the auxiliary frame 17 in the longitudinal direction. After selecting a desired size of the paper P, the depression force applied to the lever 32 is removed. As a result, the positioning projection 37 is brought into engagement with a desired one of the positioning holes 21*a*, 21*b*, 21*c*, and so on corresponding to the desired size of the paper P by the elastic force of the leaf spring portion 33 and the weight of the primary portion 31*a*. Thus, the auxiliary frame 17 is fixedly positioned in the longitudinal direction relative to the main frame 15 in accordance with the size of the desired paper P.

While the leaf spring portions 26 and 33 are formed integrally with the primary portions 19*a* and 31*a*, respectively, in the above preferred embodiments, an independent leaf spring made of metal or the like may be embedded at a base end thereof into the primary portion 19*a* or 31*a*. Alternatively, a coil spring may be provided so as to normally downwardly bias the rear end of the primary portion 19*a* or 31*a*.

Referring back to FIG. 3, reference numerals 38 designate a plurality of paper size detecting ribs projecting outwardly from the outer side surface of the right side plate 17*b* of the auxiliary frame 17 so as to correspond to the different paper sizes. Although not shown, a sensor, such as a limit switch, is provided on a side surface of a rear portion of the paper feed section of the body 1, so as to detect the paper size of the paper P currently stored in the paper cassette 2. That is, when the paper cassette 2 storing the paper P of a desired size is inserted into the paper feed section of the body 1, a desired one of the paper size detecting ribs 38 corresponding to the current paper size comes into contact with the sensor thereby determining the size of the paper P stored in the paper cassette 2. The paper size is indicated by a lamp or the like provided on the operation panel 12, for example. Thus, an operator can confirm the current paper size in the cassette.

Paper is placed in the cassette so one edge abuts the right side plate 15*b* of the main frame 15, that is, the paper is placed against the side of the main frame 15 that does not have the position adjusting member 19. Thus, paper of any size is positioned at a known position and the printer control program can determine proper margins based upon the determination of the paper size by the sensor contacting the paper size detecting ribs 38.

A cover member for covering an upper surface of a rear portion of the paper cassette 2, projecting rearwardly from the rear opening 4 of the body 1, will now be described. Referring to FIG. 2, reference numeral 40 designates a cover member in the first preferred embodiment according to the invention. The cover member 40 is pivotably supported, through a pin 39, to the body 1 at the top of the rear opening 4. In the case where a length of the paper cassette 2 is larger than that of the body 1, and, therefore, the rear portion of the paper cassette 2 inserted into the paper feed section of the body 1 projects rearward from the rear opening 4, the cover member 40 is forced by an upper edge of the rear end of the paper cassette 2 to rotate rearward and upward (i.e., counterclockwise as viewed in FIG. 2), thereby covering the upper surface of the rear portion of the paper cassette 2 projecting from the rear opening 4. In the case where the length of the paper cassette 2 is smaller than that of the body 1, or the paper cassette 2 is not inserted in the paper feed section, the cover member 40 is suspended by its self-weight from the pin 39 to close the rear opening 4.

The cover member 40 may be normally biased by a torsion spring (not shown) so as to be rotated downward (i.e., clockwise as viewed in FIG. 2). In this case, when the paper cassette 2 is drawn out of the paper feed section, the cover member 40 is forcibly rotated downward by elastic force of the torsion spring to thereby close the rear opening 4.

Figure 8:
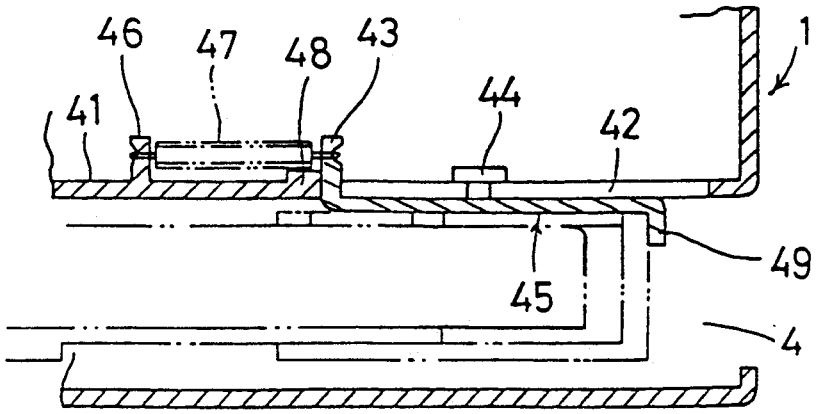
FIG. 8 is a sectional view illustrating a second preferred embodiment of a cover member.
Figure 9:
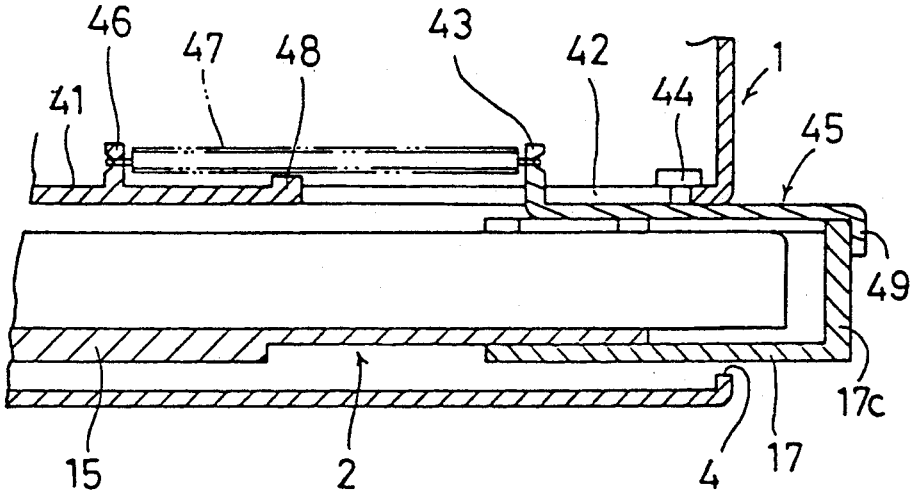
FIG. 9 is a view similar to FIG. 8, showing a condition where the paper cassette is fully mounted into a body of the image forming device.

FIGS. 8 and 9 show a second preferred embodiment of the cover member. Referring to FIGS. 8 and 9, a transversely elongated guide hole 42 is formed through a rear portion of an upper plate 41 of the paper feed section of the body 1, and a cover member 45 having two guide pins 43 and 44 is transversely movably mounted to the upper plate 41 of the paper feed section in such a manner that the guide pins 43 and 44 are slidably engaged with the elongated guide hole 42. A tension spring 47 is connected between the guide pin 43 and a hook portion 46 formed on the upper plate 41, so as to normally frontwardly bias the cover member 45. A stopper portion 48 is formed on the upper plate 41 so as to normally contact the guide pin 43 biased by the tension spring 47. In this normal condition, a rear end of the cover member 45 is maintained in a position inside the rear opening 4.

The cover member 40 is provided at its rear end with a downward projecting portion 49. In the case where the rear end portion of the paper cassette 2, inserted in the paper feed section, projects rearward from the rear opening 4, the projecting portion 49 of the cover member 45 is urged rearwardly by the rear end of the paper cassette 2 (e.g., the rear plate 17*c* of the auxiliary frame 17) so that the cover member 45 is moved rearward against the elastic force of the tension spring 47 to project rearward from the rear opening 4. Accordingly, until the paper cassette 2 is fully mounted into the paper feed section, the cover member 45 is moved rearwardly covering the upper surface of the rear portion of the paper cassette 2 as it progressively projects rearwardly from the rear opening 4 of the body 1.

Although the cover member in the above preferred embodiments is provided on the body 1 side, it may be detachably mounted on the upper surface of the rear portion of the paper cassette 2. In this case, the cover member is mounted so as to cover the upper surface of the rear projecting portion of the paper cassette 2 after the paper cassette 2 is fully mounted into the paper feed section of the body 1.

In the case where the paper feed unit (paper feed roller) is located at the front portion of the body 1 as mentioned above, there is a problem that the cover member interferes with the paper feed unit if the cover member is mounted on the rear portion of the paper cassette prior to insertion of the paper cassette into the paper feed section.

However, according to the above preferred embodiments shown in FIGS. 2 and 8, in the case where the longitudinal size of the paper cassette is larger than that of the body of the image forming device, and therefore, the rear end portion of the paper cassette inserted in the body projects rearwardly from the rear end of the body 1, the cover member for covering the upper surface of the rear projecting portion of the paper cassette in concert with the mounting operation of the paper cassette is provided to be vertically rotatable or longitudinally movable. Accordingly, there is no interference of the paper cassette with the paper feed unit upon insertion of the paper cassette, and there is no need for mounting and demounting operations of the cover member. Further, the depth of the body of the image forming device need not be enlarged, thereby realizing a compact construction of the image forming device at a low cost and saving installation space.

Furthermore, according to the above preferred embodiments, the length of the paper cassette can be varied in accordance with a size of the desired paper to be stored in the paper cassette. Accordingly, it is not necessary to produce various kinds of paper cassettes having different sizes, thereby reducing production costs for paper cassettes and greatly simplifying stock control of paper cassettes owing to a reduction in the types of paper cassettes.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A paper cassette for use with an image forming device, the paper cassette comprising:

a main frame open on an upper side and having an end wall and two side walls mounted to a bottom surface and an auxiliary frame open on an upper surface and having an end wall and two side walls mounted to a bottom surface, said auxiliary frame mounted to the main frame so as to be movable forwardly and rearwardly relative to the main frame in accordance with a desired longitudinal size of sheets of paper to be stored in a thereby formed paper cassette, wherein the paper cassette is removably mounted in a paper feed section of the image forming device.

2. The paper cassette as claimed in claim 1, wherein said main frame slidably fits inside said auxiliary frame.

3. An image forming device including a body and a paper cassette adapted to be removably mounted into the body from a front side thereof, a cover means provided on one of the body and the paper cassette for covering an upper surface of a rear portion of the paper cassette projecting rearward from a rear end of the body.

4. The image forming device as claimed in claim 3, wherein said cover is pivotally mounted to a portion of the body above an opening through which the paper cassette may project.

5. The image forming device as claimed in claim 3, wherein said cover further comprises:

a plate in the body extending over a paper cassette receiving position;

a elongated guide hole in said plate, said guide hole extending in a paper cassette insertion direction;

a cover member having a pair of projections seated in said guide hole for guiding said cover member and a downward projecting portion at a rear edge in the paper cassette insertion direction, said downward projecting portion engaging the paper cassette during insertion.

6. The image forming device as claimed in claim 5, further comprising a tension means extending between the body and one of said pair of projections.

7. An adjustable paper cassette for a printer, comprising:

a first section having a base, a front side and two lateral sides;

a second section having a base, a back side and two lateral sides, said first and second sections fitting together to form an adjustable, substantially rectangular, open topped box; and a position adjusting means for fixing said first section and said second section relative to one another at one of a plurality of positions, wherein said first section slidably fits inside said second section;

a window in said base of said first section and a plurality of paper size indicators on said base of said second section such that the paper size indicator appropriate to a size of paper to be used is viewable by an operator through said window when the cassette is properly adjusted.

8. The adjustable paper cassette as claimed in claim 7, wherein said two lateral sides of said first section are elongated to extend beyond said base of said first section, said elongated lateral sides passing through openings provided at junctions of said lateral sides and said back side of said second section.

9. The adjustable paper cassette as claimed in claim 7, wherein said position adjusting means comprises:

a supporting member extending between said base and a first lateral side of said first section;

a position adjusting member mounted in said supporting member, said position adjusting member have a projection on a bottom of a center section thereof; and an elongated hole in the base of said first section, said projection seated in said elongated hole;

a plurality of openings in the base of said second section corresponding to positions for setting the paper cassette to accommodate different size papers, said projection being selectively seated in one of said plurality of openings.

10. The paper cassette as claimed in claim 9, wherein said position adjusting member has a handle extending from one side of an upper part of said center section and a leaf spring portion extending from an opposite side of the upper part of said center section to engage said supporting member, said handle being lifted to disengage said projection from said one opening in said second section.

11. The paper cassette as claimed in claim 9, further comprising a lateral shaft extending from said first lateral side, said position adjusting member pivotally mounted thereto on a first side of said center section, a handle extending from an upper part of said center section on said first side and a leaf spring extending from the upper part on an opposite side to engage with said supporting member.

12. The adjustable paper cassette as claimed in claim 7, further comprising a cassette cover, said cassette cover mounted to the printer for covering a portion of the adjustable paper cassette extending from the printer on a side opposite to a side in which the adjustable paper cassette is inserted.

13. The adjustable paper cassette are claimed in claim 7, wherein a outer surface of said front side of said first section has a grip portion.

14. The adjustable paper cassette as claimed in claim 12, wherein said cassette cover comprises a cover member pivotally mounted to a body of the printer above an opening through which the adjustable paper cassette may extend.

15. The adjustable paper cassette as claimed in claim 12, Wherein said cassette cover further comprises:

a plate in a body of the printer extending over a cassette receiving position;

a elongated slot in said plate, said slot extending in a cassette insertion direction;

a cover member having a pair of projections seated in said slot for guiding said cover member and a downward projecting portion at a rear edge in the cassette insertion direction, said downward projecting portion engaging the adjustable paper cassette during insertion.

16. The adjustable paper cassette as claimed in claim 15, further comprising a tension means extending between the body of the printer and one of said pair of projections.

17. The paper cassette as claimed in claim 11, further comprising paper size detecting means provided on an outer surface of one of said lateral sides of said second section for detecting a paper size of paper stored in the paper cassette.

* * * * *